United States Patent [19]

McMillan

[11] 4,029,927

[45] June 14, 1977

[54] MICROWAVE WATER HEATER

[76] Inventor: Hugh G. McMillan, 2920 Walnut St., Tampa, Fla. 33607

[22] Filed: Nov. 28, 1975

[21] Appl. No.: 636,117

[52] U.S. Cl. ..... 219/10.55 R; 219/10.55 A

[51] Int. Cl.[2] ..... H05B 9/06

[58] Field of Search ..... 219/10.55 R, 10.55 A, 219/10.55 N, 10.55 F

[56] References Cited

UNITED STATES PATENTS

| | | | |
|---|---|---|---|
| 2,398,606 | 4/1946 | Wang | 219/10.55 R X |
| 2,585,970 | 2/1952 | Shaw | 219/10.55 R X |
| 2,978,562 | 4/1961 | Fox | 219/10.55 R X |
| 3,092,514 | 6/1963 | Tomberlin | 219/10.55 R X |
| 3,535,482 | 10/1970 | Kluck | 219/10.55 R |
| 3,778,578 | 12/1973 | Long | 219/10.55 R |
| 3,812,315 | 5/1974 | Martin | 219/10.55 R |
| 3,816,689 | 6/1974 | Long | 219/10.55 R |
| 3,920,945 | 11/1975 | Smith et al. | 219/10.55 R |

*Primary Examiner*—Arthur T. Grimley

*Attorney, Agent, or Firm*—Duckworth, Hobby, Orman, Allen & Pettis

[57] ABSTRACT

A water heater assembly of the type primarily designed for domestic and/or residential use and including a storage tank having fresh water inlet and water supply outlet disposed in fluid communication with the interior of the tank wherein the tank has mounted thereon a microwave generator disposed in wave directing relation to the water within the tank. Current regulating means is interconnected between a source of electric current supply and the microwave generator so as to control its activation. A sensing means in the form of a thermostat designed to control activation of the microwave generator upon the water and/or the tank reaching a predetermined temperature. A safety assembly is mounted on the tank and includes temperature sensing device disposed and constructed to either cease operation of the microwave generator or eliminate the water from the tank so as to reduce its temperature and prevent serious damage to the device or its surroundings.

7 Claims, 4 Drawing Figures

MICROWAVE WATER HEATER

BACKGROUND OF THE INVENTION

1. Field of the invention

This invention relates to a domestic type water heater having a water heating assembly interconnected to conventional current supply for the purpose of heating the water within the storage facility in an efficient manner utilizing a minimal amount of energy and thereby saving fuel costs, etc.

2. Description of the Prior Art

With the advent of modern technology there has been an increasing demand and need for an effective and efficient manner of providing heated water. Effective water heating assemblies are particularly desirable or domestic or residential use as well as industrial application. Currently the conventional domestic water heaters commonly are either electric powered or fuel oil powered which operate with varying amounts of efficiency dependent upon the particular design and application.

Through the years the cost of energy has steadily risen due to a depletion of the world's fossil fuel supply such as oil and/or the establishment of environmental protection standards which make certain types of fossil fuel illegal or undesirable for use on a large scale basis.

Because of the increased cost of operation of electric, natural gas or oil operated appliances, there has been a widespread demand for a cheaper source of energy or an appliance design and structure capable of operating on a more efficient basis utilizing the conventional sources of energy. Through this demand there has been an increase in the popularity of solar powered appliances including water heaters.

However, even though solar heating systems have been in practice for some years there are recognized inherent disadvantages found in these prior art systems. One of the most prevalent complaints in the practical application of a solar heater system is the inefficiency and inconvenience of dependence an a certain amount of days when the sun's radiation is readily availabe andor focused on the heat collecting system of a solar heating system.

Accordingly, since the majority of present or prior art heating systems do utilize relatively large amounts of energy which have become increasingly expensive, there is an obvious need in the industry for a heating system which is versatile enough to be adapted to both industry and domestic use and which operates effectively and efficiently at relatively low cost.

SUMMARY OF THE INVENTION

This invention relates to a water heating assembly primarily designed for domestic or residential use but which, with proper inclusion of additional storage capacity could be readily adapted for industrial, high capacity usage.

The water heating assembly of the present invention includes a main storage means in the form of a tank designed and configured to store water in the interior thereof. A fresh water or cold water supply is interconnected to an inlet means in the form a of a conduit extending into the interior of the tank and through which fresh water is delivered. An outlet means in the form of an appropriate conduit is disposed in fluid communication between the interior of the tank and the water therein and the desired point of delivery for use.

Insulation means is mounted on the exterior of the tank in at least partially surrounding relationship thereto so as to provide adequate insulation covering. This not only serves to better maintain the temperature of the water within the tank but also prevents harm caused by accidental contact with the exterior of the tank surface itself when the tank is of a sufficient temperature to do bodily damage. The insulation means further includes material capable of providing proper microwave shielding for the microwave energy directed into the interior of the tank by a microwave generator to be described in detail hereinafter. More specifically, the microwave shielding is properly placed so as to prevent or eliminate any misdirection of the microwave energy as it is directed to the water on the interior of the tank during heating thereof.

A microwave generator, which may comprise a microwave emitter of conventional or standard design capable of utilization with the particular application of hot water heaters is mounted in specific, predetermined relation to the tank so as to direct microwave energy to the interior of the tank and apply it to the water being heated. Regulating means in the form of a control console and/or switching apparatus is interconnected between a conventional source of electric current and the microwave emitter or generator means. This regulating means serves to control current being directed from the conventional power source to the microwave emitter to control its operation and/or activation. The regulating means includes an on-off switch and is further interconnected to a temperature sensing means which, based on the temperature of the tank or water therein serves to activate and deactivate, through proper circuitry, the microwave emitter. This sensing means may be in the form of a thermo sensitive, thermostatic control device designed to maintain the water within the tank between certain given temperature parameters.

The present invention further comprises safety means which may be in the form of a fuse element including a thermo sensitive spring biased switch disposed in circuit breaking relation relative to the regulating means and/or source of current supplied thereto. In operation, upon failure of the sensing means to maintain the water within the desired temperature range, the fuse elements will sense any extraordinary heat build-up of the tank itself and will activate into its circuit breaking positon upon the reaching of a predetermined temperature beyond the safe condition. Upon this occurrence the circuit is broken and proper current directed from the conventional current source to the microwave emitter ceases thereby causing deactivation of the emitter and a natural lowering of the temperature of the water therein.

The safety means further includes a release plug or valve arrangement wherein upon failure of both the thermostatic sensing means and the fuse element, the release plug means will melt due to the excess temperature thereby causing a voiding of the overheated water from the interior of the tank so as to reduce the possibility of explosion or other severe damage to the storage means and the surrounding area.

An additional structural feature of the present invention includes a distributing means in the form of at least one distributing plate disposed on the interior of the tank in transverse relation between the flow of water from the cold water inlet means to the outlet means. The distributor plate comprises a plurality of apertures formed therein and disposed relative to one another in predetermined relation such that water passing from the inlet means is forced through the formed apertures in the distribution plate so that the cold water entering is spread substantially evenly throughout the interior of the tank so as to provide uniform heating of the content of the tank prior to the water reaching the water outlet.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION

Figure 1:
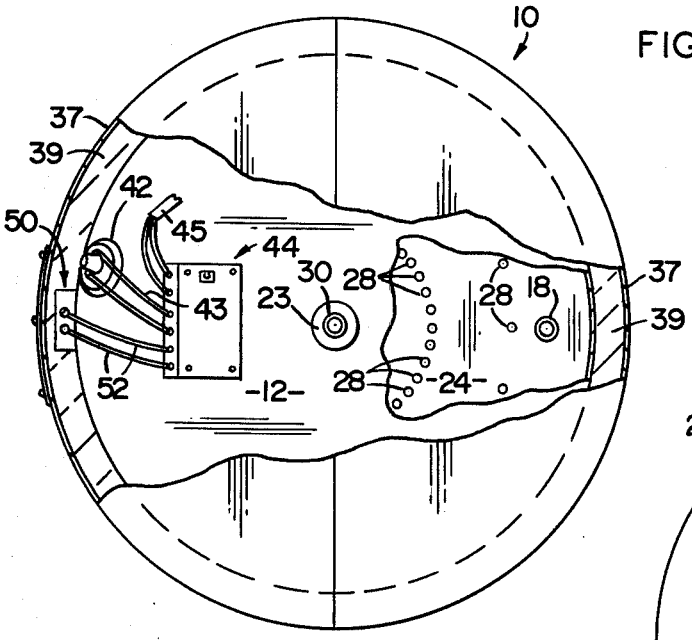
FIG. 1 is a top partial cutaway view in partial sections showing the exterior and interior structural features of the water heater assembly of the present invention.
Figure 3:
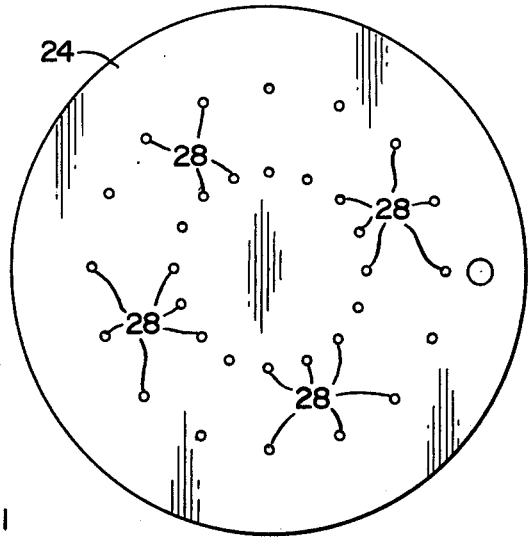
FIG. 3 is a detailed view of the distributor plate.
Figure 2:
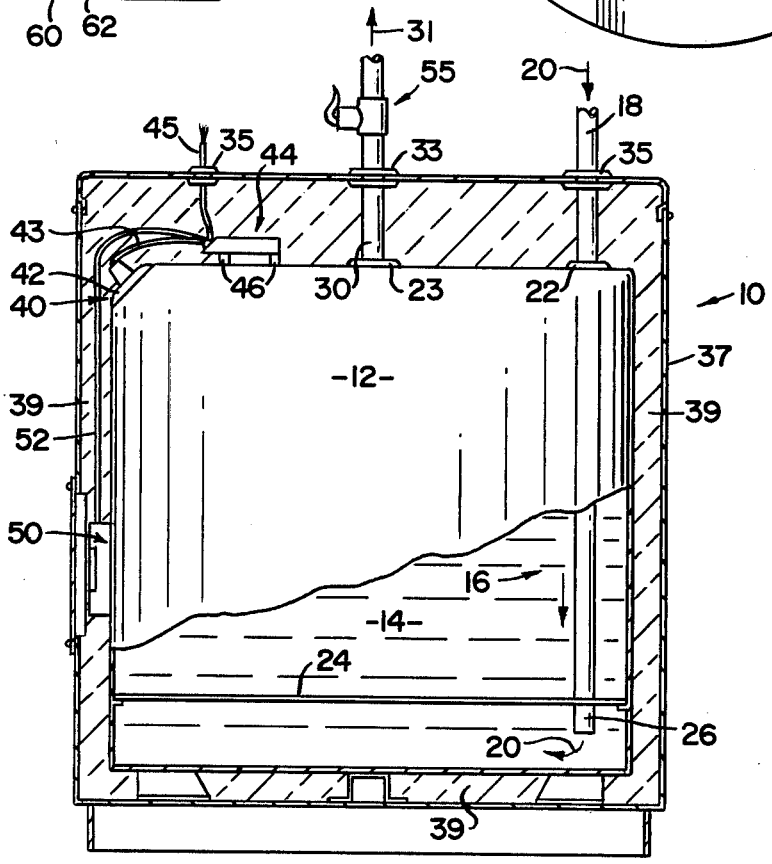
FIG. 2 is a front sectional view showing the interior of the storage means and the relative disposition of the structural features of the water heating assembly.

As shown in FIG. 1 and 2 the water heater assembly of the present invention is generally indicated as 10 and includes a storage means in the form of a main storage tank 12 being specifically designed and configured to have a predetermined capacity of water 14 stored on the interior thereof. A water inlet means generally indicated as 16 includes conduit 18 extending from the exterior of the assembly 10 to the interior thereof as indicated by directional arrows 20. Conduit 18 is connected to a conventional source of cold water supply and serves to fill the interior of tank 12 upon demand. Seal bushing 22 is disposed at the interconnection of the conduit 18 and the exterior of the tank 12 as shown (FIG. 2). In one embodiment of the present invention the conduit 18 extends throughout the depth of tank 12 to a point below the distribution means in the form of distributor plate 24 which will be described in detail hereinafter. Accordingly, the distal end 26 of conduit 18 is disposed contiguous to or beyond the plane defined by the distributor plate 24 so as to force the cold water entry below this plate. With reference to FIG. 3 plate 24 comprises a plurality of apertures 28 formed therein in predetermined relation to one another. In that the plate 24 is disposed in transverse relation to the path of fluid flow of the water from the inlet conduit 18 to the outlet conduit 30, the cold water is evenly distributed throughout the tank. This even distribution facilitates the even or consistent heating or temperature maintenance of the water being subjected to the microwave emitter, to be described in detail hereinafter. The outlet conduit 30 is interconnected to the interior of the tank 12 and communicates, as indicated by directional arrow 31 with the desired point of water delivery. Proper bushing and/or washer means 33 is connected to the junction of conduit 30 and the exterior of the casing. Similarly bushing means 23 is located at the junction point of conduit 30 and the tank 12. Similar busing and/or connector elements 35 may be located at various points where interconnection to the actual casing 37 or tank 12 are utilized.

Insulation means generally indicated as 39 is disposed between the outer shell or casing 37 and the exterior surface of the tank 12 as shown. This insulation means is disposed to provide protection from the possibly harmful temperature of the tank itself as well as to maintain the desired water temperature within the tank as efficiently as possible. The insulation means may further comprise a shielding composition incorporated within the material 39. This shielding means may be any applicable composition capable of preventing misdirection of the wave energy being generated from the microwave emitter generally indicated as 40. The microwave generator 40 comprises a conventional microwave emitter element 42 mounted on tank 12 and/or alternately on the water heater assembly so as to properly direct microwave energy to the interior of tank 12 and more specifically to the water therein. By virtue of this arrangement the water is heated much more rapidly and accordingly more efficiently than if conventional electric or oil or gas burning heater units were utilized. The conventional structure and/or design of the microwave emitter can be any design or structure that is applicable to accomplish the intended purpose as set forth herein and such microwave emitters are commercially available. The microwave emitter 42 is electrically connected by proper conductor 43 to a regulator means generally indicated as 44. The regulator means in turn is disposed in interconnecting relation between a source of conventional electric current (not shown) through conductor 45. The housing for the regulator means 44 includes support means or brackets 46 interconnected to the exterior of the tank 12 or at any other applicable location relative to the intended function. The regulator means may include an on-off switch activated by proper pushbutton mounted on the regulator means 44 so as to control direct current flow from the power source to the microwave emitter 42.

A sensing means generally indicated as 50 may be secured to the exterior of tank 12 or to any other desired location wherein proper sensing of the temperature of the tank or the water therein can be determined. The sensing means 50 may comprise a thermostat and/or thermo sensitive element which is interconnected by conductor 52 to the regulator means 44. Proper circuitry is maintained within the regulator means so as to allow the thermostat means 50 to control activation and deactivation of the microwave emitter through current regulation in order to maintain the water 14 within tank 12 within the desired temperature parameters. Again, the sensing means may be of relatively conventional design having the operating characteristics of sensing the temperature of the tank and/or the water therein so as to maintain this water within the proper, predetermined parameters. The sensing means should have a preset capability wherein the parameters may be changed dependent upon the particular application for the water issuing from the heater assembly.

Figure 4:
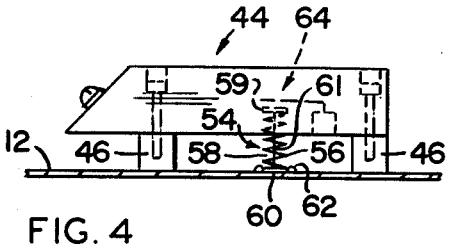
FIG. 4 is a side detailed view of the safety means including a fuse element attached to the exterior of the tank.

As shown in FIG. 4 the water heater assembly of the present invention comprises a safety means generally indicated as 54 mounted on the exterior surface of tank 12 in heat conductive relation thereto. This safety means is in the form of a fuse element 56 comprising a thermo sensitive, spring biased circuit breaker type switch which is activated when the temperature of the tank exceeds the set thermostatic temperature deactivation point. More specifically, this fuse element 56 comprises a compression spring 58 held by two caps 59 and 60 with an internally disposed wire element 61. Each end of the wire element 61 is soldered to the oppositely disposed caps. When a high temperature is sensed in the tank the solder 62 securing the caps melts causing release of the spring which in turn pushes the circuit breaker mechanism generally indicated in broken lines as 64 inside the regulator means 44. The circuit is accordingly broken and the microwave emission is stopped through deactivation of the microwave generator means 40.

The safety means of the present invention further comprises a release plug means generally indicated as 55. This release plug is formed of a composition of meltable material when a certain excess temperature is reached. Accordingly, upon the malfunction of the sensing means 50 and the fuse element 54, determination that water passing through conduit 30 as indicated by directional arrow 31 is in excess of the desired and/or dangerous temperature, the release plug means 55 will melt or deteriorate causing a voiding of the interior of tank 12 so as to lower the temperature of the entire apparatus and thereby prevent harm form explosion, etc.

It will thus be seen that the objects set forth above, among those made apparent from the preceding description, are efficiently attained, and since certain changes may be made in carrying out the above method and article without departing from the scope of the invention, it is intended that all matter contained in the above description shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

Now that the invention has been described, what is claimed is:

1. A water heater assembly of the type primarily designed for domestic use, said water heater assembly comprising: water storage means including a tank, inlet means interconnected between a water supply and the interior of said tank, outlet means interconnected between the interior of said tank and a desired point of water delivery; insulation means mounted on the exterior of said tank in at least partially surrounding relation thereto; microwave generator means connected to said storage means and disposed to direct wave energy to the water within said tank, regulating means interconnected in current regulating position between a current source and said microwave generator, temperature sensing means mounted on said storage means in temperature sensing disposition relative to the water within said tank and in current regulating relation to said microwave generator; safety means interconnected to said regulating means and disposed in direct heat conducting relation to said tank, so as to sense the temperature thereof; said assembly further comprising distribution means mounted on the interior of said tank, said distribution means comprising a plate element having apertures formed therein and disposed substantially uniformly in said plate so as to define fluid communication therethrough between opposite sides of said plate, said plate element disposed in transverse relation relative to water flow between said inlet means and said outlet means, said plate being configured and disposed to allow water, issuing from said water inlet to pass through said apertures in a dispersed fashion so as to be distributed evenly throughout said tank, whereby wave energy directed to the water from said microwave generator causes temperature increase therein.

2. A water heater assembly as in claim 1 wherein said insulation means further comprises wave energy shielding means mounted in said storage facility, whereby harmful misdirection of wave energy is regulated.

3. A water heater assembly as in claim 1 wherein said safety means comprises a first fuse element disposed in heat sensing relation to the water within said tank.

4. A water heater assembly as in claim 3 wherein said first fuse element comprises a thermo sensitive device mounted in heat conductive relation on a surface portion of said tank and in current regulating relation between the source of current and said microwave generator.

5. A water heater assembly as in claim 4 wherein said thermo sensitive device comprises a spring biased switch disposed in circuit breaking relation between said microwave generator and the current supply.

6. A water heater assembly as in claim 1 wherein said safety means further comprises a release plug means mounted on said tank in heat sensing relation thereto, said release plug means comprised of a composition meltable at a predetermined temperature, whereby water within said tank is released through said release plug means upon said tank reaching a predetermined temperature.

7. A water heater assembly as in claim 1 wherein said regulating means further comprises an on-off switch disposed to control current flow to said microwave generator and actuation thereof.

* * * * *